United States Patent [19]

Takeuchi et al.

[11] 4,163,358

[45] Aug. 7, 1979

[54] APPARATUS FOR CONTROLLING THE DRIVING OF AN OPEN-END SPINNING MACHINE

[75] Inventors: Tatuo Takeuchi, Aichi; Kazuyoshi Ono, Chiryu; Naotake Furukawa, Aichi; Katsuaki Sugiura, Okazaki; Osamu Suzuki, Obu; Takeshi Shimizu, Kariya, all of Japan

[73] Assignee: Kabushiki Kaisha Toyoda Jidoshokki Seisakusho, Aichi, Japan

[21] Appl. No.: 870,751

[22] Filed: Jan. 19, 1978

[51] Int. Cl.[2] ..... D01H 1/12; D01H 1/22

[52] U.S. Cl. ..... 57/78; 57/263

[58] Field of Search ..... 57/34 R, 58.89–58.95, 57/78, 80, 81, 156, 263

[56] References Cited

U.S. PATENT DOCUMENTS

| | | | |
|---|---|---|---|
| 3,541,774 | 11/1970 | Sterba et al. | 57/78 |
| 3,803,823 | 4/1974 | Niestroj et al. | 57/34 R |
| 3,988,879 | 11/1976 | Franzolini et al. | 57/34 R |
| 4,033,107 | 7/1977 | Sasayama et al. | 57/81 |
| 4,050,226 | 9/1977 | Brozkova et al. | 57/34 R |

*Primary Examiner*—Charles Gorenstein

*Attorney, Agent, or Firm*—Burgess, Ryan and Wayne

[57] ABSTRACT

An apparatus for controlling the driving of an open-end spinning machine whereby driving members such as feed roller, winding roller and draw-off roller are operated at timings optimum for spinning conditions at the time of starting or stopping the machine. Optimum conditions are determined by the amount of yarn wound on a yarn take-up roll of the apparatus.

10 Claims, 9 Drawing Figures

APPARATUS FOR CONTROLLING THE DRIVING OF AN OPEN-END SPINNING MACHINE

BACKGROUND OF THE INVENTION

In an ordinary open-end spinning machine, a fiber bundle, fed by a fiber bundle feed device such as a feed roller, is liberated into individual fibers by an opening device such as a combing roller. The liberated individual fibers are fed into a spinning rotor and deposited on a ring shaped accumulation wall of the spinning rotor, so that a ring shaped fiber bundle is continuously formed on the accumulation wall of the spinning rotor. Then, the bundle of fibers is separated from the above-mentioned ring shaped fiber bundle while imparting twist to the bundle of fibers by the high speed rotation of the spinning rotor and, consequently, a twisted bundle of fibers, that is a yarn, is created. The yarn is taken from the spinning rotor via a guide tube by means of a drawing off mechanism composed of a draw-off roller and a top roller driven by frictional contact with the draw-off roller. The yarn is formed on a bobbin which is rotatably mounted on a winding roller by the principle of frictional contact, so that a yarn package such as a cheese is formed on the bobbin.

In the above-mentioned open-end spinning machine, an apparatus for controlling the driving of the driving elements at the time of starting or stopping the spinning operation has been utilized. That is, the starting or stopping of the driving of the driving members towards the normal direction or the reverse direction, etc., are carried out in a controlled condition with appropriate timing in connection with other driving members according to the controlled signals issued from the control apparatus. As a result the spinning operation is carried out under good conditions. For example, at the time of starting the machine, the rotary spinning chamber or the like is actuated and, simultaneously, the draw-off roller and winding roller are rotated in a reverse direction. Consequently, the end of the yarn wound on the bobbin in the form of a cheese is fed back to the interior of the rotary spinning chamber through the guide tube. After the lapse of a certain period of time from the start of the reverse rotation of the draw-off roller and winding roller, the fiber bundle feed device is actuated by a timer or the like mounted in the control apparatus to feed liberated fibers into the spinning rotor. By another timer or like means mounted in the control apparatus, after the lapse of a certain period of time from the start of the reverse rotation of the draw-off roller and winding roller, the rotation direction of these rollers is changed over from the reverse direction to the normal direction, and the yarn piecing operation is performed in the rotary spinning chamber.

When the operation of the machine is stopped, in order to perform the yarn piecing operation assuredly at the start of the spinning operation of the subsequent cycle after the lapse of a certain period of time from the stopping of the device for feeding a bundle of fibers when the driving motor of the open-end spinning machine is stopped, the rotation of the draw-off roller and the winding roller are controlled so as to be able to stop in such a condition that the yarn end is retained in the guide tube. The above-mentioned time control is carried out by utilizing timers or like means disposed in the control apparatus.

With advance of the winding operation, the quantity of the yarn wound on the package increases. Since a slip between the yarn package and the winding roller at the time of the starting or stopping increases in accordance with the change of the weight of the yarn package, operational timings of the respective driving members set to be actuated at predetermined time intervals become upset and it becomes impossible to maintain good spinning conditions. That is, since the timing of delayed initiation of the feeding of fibers and the timing of delayed changeover of the rotation direction of the draw-off roller and winding roller from the reverse direction to the normal direction are set in predetermined conditions respectively by a timer or like means, when the reverse rotation of the draw-off roller and winding roller is started, a large force of inertia is imposed on the yarn package, because the quantity of the yarn wound on the yarn package has become large, and a slip is caused between the yarn package and winding roller. Owing to this slip, the rotation of the yarn package is started later than the rotation of the winding roller and, therefore, the contact timing between the end of the yarn fed back to the spinning rotor and the fibers fed to the spinning rotor from the opening device becomes upset. Further, when the rotation direction of the draw-off roller and winding roller is changed over from the reverse direction to the normal direction, a large force of inertia acts on the yarn package because the quantity of the yarn wound on the yarn package has become large. Therefore, owing to a slip caused between the yarn package and the winding roller, the rotation direction of the yarn package is changed over to the winding direction (normal direction) at a time later than the change of the rotation direction of the winding roller. Accordingly, the timing of drawing out the yarn from the spinning rotor becomes upset and the ratio of success in the yarn piecing operation is remarkably reduced. This is a first defect involved in the conventional control apparatus of the open-end spinning machine.

Since the timing of delayed stopping of the draw-off roller and winding roller is set with regard to predetermined constant conditions respectively by the timer or like means, as mentioned hereinbefore, when the driving of the draw-off roller and winding roller are abruptly controlled and stopped, a large force of inertia is imposed on the yarn package because the quantity of the yarn wound on the yarn package has become large and a slip is caused between the cheese and winding roller. Owing to this slip, the tension on the yarn is drastically increased between the yarn package and the nip point of the draw-off roller and the top roller, so that the yarn is possibly broken. Naturally, such yarn breakage renders the yarn piecing operation difficult at the start of the spinning operation of the subsequent cycle. This is another defect involved in the conventional control apparatus of the open-end spinning machine.

SUMMARY OF THE INVENTION

It is, therefore, a primary object of the present invention to overcome and eliminate the above-mentioned defects involved in the conventional control apparatus of the open-end spinning machine. More specifically, the primary object of the present invention is to provide a novel control method and apparatus for an open-end spinning machine, in which the quantity of a yarn wound on a yarn package is detected at the time of starting the machine, the timing of initiation of feeding of opened fibers and the timing of changing over the rotation direction of a winding roller from the reverse direction to the normal direction are set based on a signal of detection of the quantity of the yarn on the yarn package, so that as the quantity of the yarn wound on the cheese becomes large, the timing of initiation of delayed feeding of opened fibers is retarded and the timing of delayed changeover of the rotation direction of the draw-off roller and the winding roller from the reverse direction to the normal direction is quickened, whereby the ratio of success in the yarn piecing operation is remarkably enhanced.

In accordance with the present invention, the above-mentioned object can be attained by the following structural features.

(1) The quantity of a yarn wound on a yarn package is detected at the time just before stopping the machine, and the timing of stoppage of the winding roller is set based on a signal of detection of the quantity of the yarn on the yarn package. As a result the timing of delayed stopping of the draw-off roller and winding roller is retarded as the quantity of the yarn wound on the yarn package becomes large. After a machine motor is stopped, according to the quantity of the yarn on the yarn package, the rotation speed of the draw-off roller and winding roller is reduced to a low level and the driving of the rollers are then controlled and stopped. Consequently, the possible yarn breakage owing to a slip caused between the yarn package and the winding roller can be definitely prevented.

(2) The quantity of a yarn wound on a yarn package is detected the time just before starting the machine operation, and the timing of initiation of feeding of opened fibers and the timing of changing over the rotation direction of the winding roller from the reverse direction to the normal direction are set based on a signal of detection of the quantity of the yarn wound on the yarn package. As a result, as the quantity of the yarn wound on the yarn package becomes large, the timing of delayed initiation of feeding of opened fibers is retarded and the timing of delayed changeover of the rotation direction of the draw-off roller and winding roller from the reverse direction to the normal direction is quickened. Consequently, the ratio of success in the yarn piecing operation is enhanced.

DETAILED DESCRIPTION OF THE PREFERRED EMBODIMENTS

The structure of an open-end spinning machine to which one embodiment of the driving control apparatus of the present invention is applied will now be described by reference to the accompanying drawings.

Figure 1:
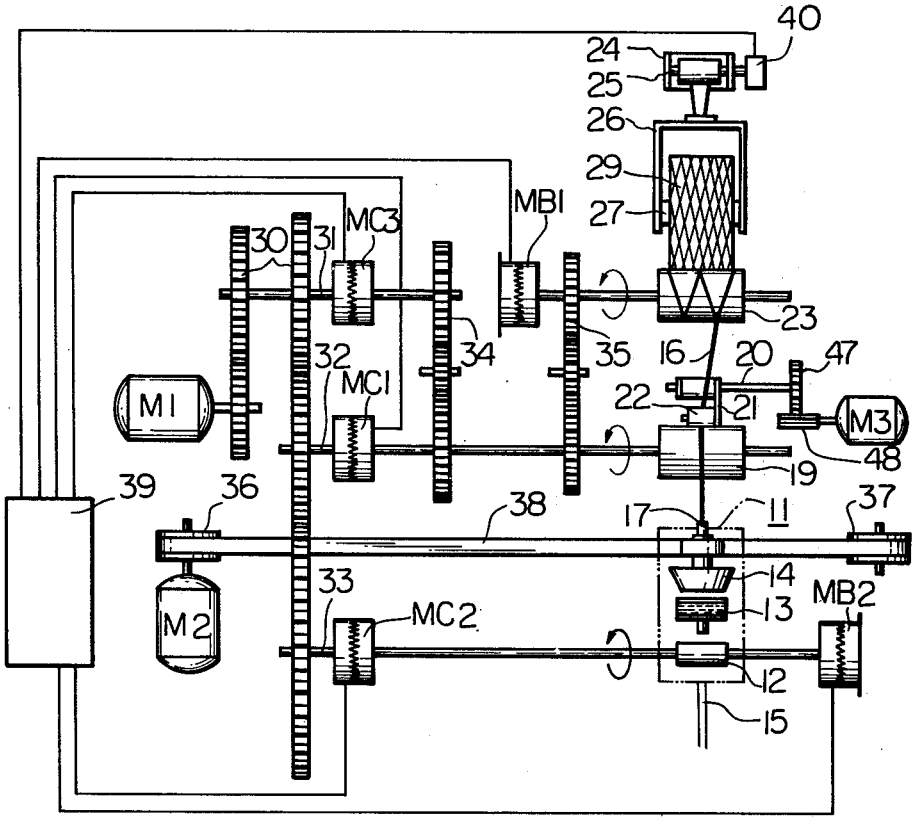
FIG. 1 is a gear diagram illustrating one embodiment of the driving control apparatus of an open-end spinning machine according to the present invention.
Figure 2:
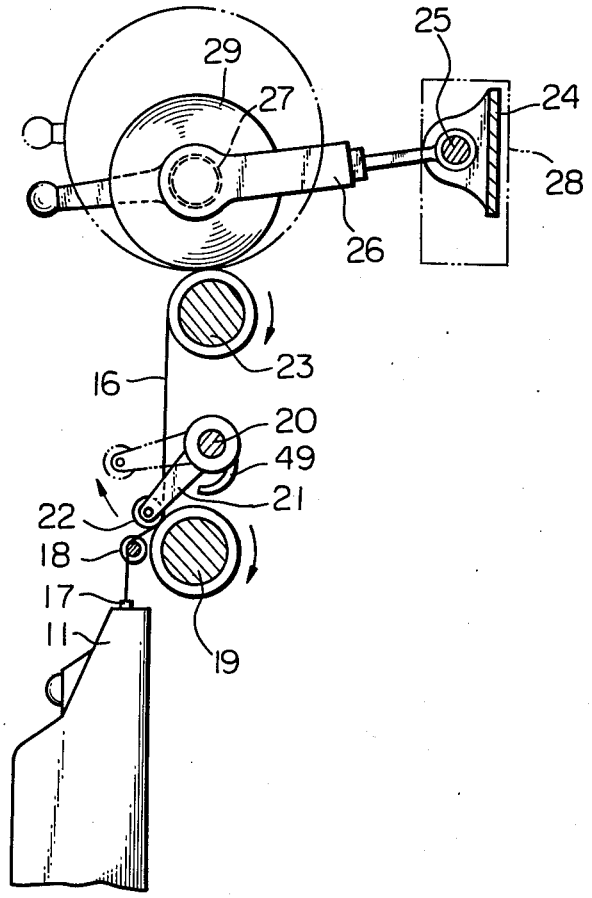
FIG. 2 is a schematic side view showing the longitudinal section of a spinning unit.

As in a conventional open-end spinning machine, in the present embodiment, a number of spinning units are aligned in both sides of the machine, and one of such spinning units is illustrated in FIGS. 1 and 2. In each spinning unit, a feed roller 12, a combing roller 13 and a rotary spinning chamber 14 are disposed in a yarn spinning unit 11. With rotation of these members, a fiber bundle 15 fed by the feed roller 12 is liberated into individual fibers by the combing roller 13, and the liberated individual fibers are accumulated and twisted by the rotary spinning chamber 14 to form a yarn 16. The yarn 16 is then delivered to the outside through a guide tube 17.

As is apparent from FIG. 2, a guide rod 18 for all the spinning units is disposed above the guide tube 17 and a draw-off roller 19 is positively rotatably mounted on each spinning unit. A supporting rod 20 is positioned above the draw-off roller 19. Roller holders 21 of the respective spinning units are rotatably supported on this supporting rod 20 and a top roller 22 is rotatably mounted on the top end of each roller holder 21. A coil spring (not shown) is positioned between each roller holder 21 and the supporting rod 20 to urge the top roller 22 into pressing contact with the peripheral surface of the draw-off roller 19. Accordingly, when the draw-off roller 19 is rotated, the top roller 22 is rotated simultaneously in all the spinning units by pressing contact with the draw-off roller 19, and the yarn fed out from the guide tube 17 of each yarn spinning unit 11 is nipped between the rollers 19 and 22 and taken out upwardly.

A winding roller 23 common to all the spinning units is positively rotatably disposed above the supporting rod 20. Supporting shafts 25 for the respective spinning units are rotatably supported on a fixed supporting frame 24 disposed above the rear part of the winding roller 23. A cradle arm 26 is fixed to the base end of the supporting shaft 25 and a bobbin 27 is rotatably supported between the top ends of the cradle arm 26. As is briefly shown in FIG. 2, a pressing device 28 is located between the supporting shaft 25 and the fixed supporting frame 24 to press each bobbin 27 to the peripheral surface of the winding roller 23. Accordingly, when the winding roller 23 is rotated, the bobbin is rotated simultaneously in all the spinning units by pressing contact with the winding roller 23, and the yarn 16 taken out by the draw-off roller 19 and the top roller 22 is wound on the bobbin 27 to form a yarn package 29.

The structure of the apparatus for driving each of the above-mentioned spinning units will now be described, particularly by reference to FIG. 1 in the embodiment shown in FIG. 1, two motors $M_1$ and $M_2$ are mounted on the spinning machine. The motor $M_1$ drives a normal rotation shaft 31 and a reverse rotation shaft 32 through a gear mechanism 30. A driving shaft 33 is also driven by the motor $M_1$ through the gear mechanism 30. The rotation of the normal rotation shaft 31 is transmitted to a draw-off roller 19 through an electromagnetic clutch MC3 and a gear mechanism 34. The rotation of the reverse rotation shaft 32 is transmitted to the draw-off roller 19 through an electromagnetic clutch MC1. The winding roller 23 is arranged so that it is rotated with the draw-off roller 19 in the same direction through a gear mechanism 35. The rotation of the driving shaft 33 is transmitted to a feed roller 12 in each yarn spinning unit 11 through an electromagnetic clutch MC2. Electromagnetic brakes MB1 and MB2 are mounted on the shaft ends of the winding roller 23 and feed roller 12 so that the draw-off roller 19, winding roller 23 and feed roller 12 are controlled and can be stopped at the time of the stopping of the operation of the machine. A belt 38 laid out between pulleys 36 and 37 is rotated and driven by the other motor M2 and the rotary spinning chamber 14 in each yarn spinning unit 11 is driven by the belt 38. The above-mentioned motors M1 and M2, electromagnetic clutches MC1, MC2 and MC3 and electromagnetic brakes MB1 and MB2 are controlled according to a predetermined program by an electrical control device 39. Also the combing roller 13 is driven through a belt by a motor (not shown), and it is controlled so that it is driven substantially synchronously with the driving of the spinning rotor 14.

The structure of the detecting device for sensing the quantity of a yarn wound on the yarn package 29 at the time just before starting or stopping the operation of the machine will now be described mainly by reference to FIGS. 4 to 6.

Figure 4:
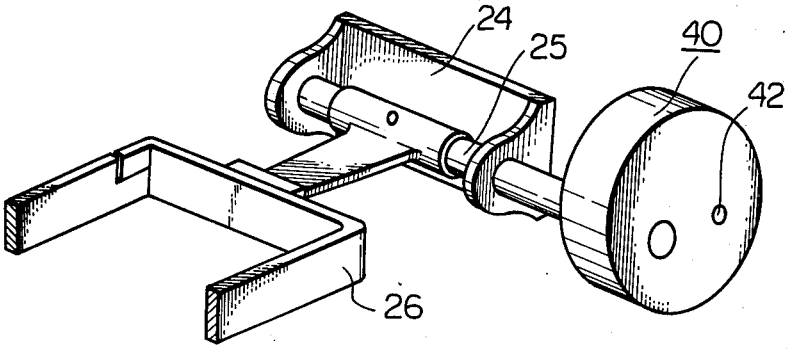
FIG. 4 is a perspective view showing one embodiment of a device for detecting the quantity of a yarn wound on a yarn package.
Figure 5:
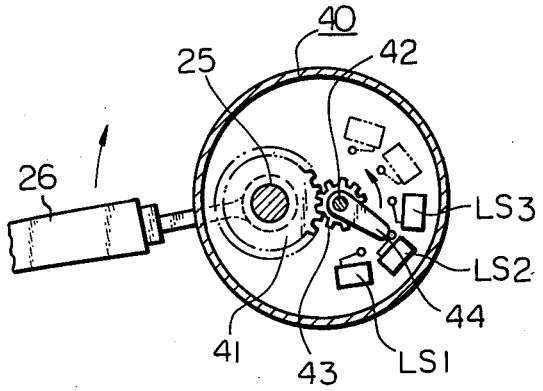
FIG. 5 is a view showing the inside of the detecting device illustrated in FIG. 4.

A detecting device 40 according to an embodiment shown in FIGS. 4 and 5 is mounted on the end of the supporting shaft 25 of the cradle arm 26 so that the quantity of the yarn of the yarn package 29 is sensed and detected according to the rotational angle of the supporting shaft 25. More specifically, a large-diameter gear 41 is fixed to the end of the supporting shaft 25 and a small-diameter gear 43 is fixed to the outer periphery of a rotation shaft 42 in such a condition that the small-diameter gear 43 can be engaged with the large-diameter gear 41. A rotary lever 44 is fixed to the rotation shaft 42 and a plurality of sensing switches, such as limit switches LS1, LS2 and LS3 . . . , are located within the rotation locus of the rotary lever 44. Accordingly, as the quantity of the yarn of the yarn package 29 becomes large, the rotary lever 44 is turned in a counterclockwise direction in FIG. 5 and the sensing switch LS1, LS2 or LS3, corresponding to the quantity of the yarn on the cheese 29, is closed by the top end of the rotary lever 44. The detection signal of the sensing switch is input to the electric control device 39 (FIG. 1). This electric control device 39 acts on receipt of the signal in such a manner that, at time of the start of the machine, as the quantity of the yarn of the yarn package 29 becomes large, the timing of the delayed start of the feed roller 12 is retarded and the timing of the delayed changeover of the rotation direction of the draw-off roller 19 and winding roller 23 from the reverse direction to the normal direction is quickened, and; that, at the time of the stopping of the machine, as the quantity of the yarn of the yarn package 29 becomes large, the timing of delayed stopping of the draw-off roller 19 and winding roller 23 is retarded. The number of sensing switches can be increased according to need as indicated by two-dot chain lines in FIG. 5.

Another embodiment of the detecting device shown in FIG. 6 will now be described. A detecting device 40 of this embodiment is disposed on the inside of the cradle arm 26 to detect directly the quantity of a yarn of the yarn package 29. More specifically, a plurality of sensing switches, such as photoelectric tubes LS1, LS2 and LS3, each consisting of a light emitting element 45 and a light receiving element 46, are disposed on the inside of the cradle arm 26, and according to the quantity of the yarn of the yarn package 29, in any of the sensing switches LS1, LS2 and LS3, the light from a certain light emitting element 45 to the corresponding receiving element 46 is intercepted to emit a detection signal. Also in this embodiment, the number of sensing switches can be increased according to need.

In addition to the above-mentioned embodiments, there may be employed other arrangements as means for detecting the quantity of the yarn of the yarn package 29 at the time just before starting or stopping the operation of the machine. For example, the element 40 shown in FIG. 1 may comprise a potentiometer or the like attached to the portion of the supporting shaft 25 of the cradle arm 26 to detect the quantity of the yarn of the yarn package from the rotational angle of the supporting shaft 25; or a plurality of photoelectric tubes may be disposed so that the light is intercepted by the cradle arm 26 and the quantity of the wound yarn is detected from the rotational position of the cradle arm. Further, an autocounter mounted (not shown) on the spinning machine may be used as means for detecting the quantity of the yarn of the yarn package.

In the embodiment illustrated in FIG. 1, there is adopted a structure in which at the time of the starting or stopping of the operation of the machine, the top roller 22 is separated from the draw-off roller 19 to release the yarn 16 from the nip between the rollers 19 and 22, whereby variations of the tension on the yarn 16 owing to slips of the cheese 29 are moderated and breakage or loosening of the yarn is prevented. This structure will now be described by reference to FIGS. 1 to 3.

A driven gear 47 is fixed to one end of the supporting rod 20 and a driving gear 48 attached to the shaft of the motor M3 is engaged with the driven gear 47. As a result at the time of the stopping of the operation of the machine, with reversing of the motor M3 the supporting rod 20 is turned by a predetermined angle in a clockwise direction from the position shown in FIG. 2, and; after completion of the yarn piecing operation at the start of the operation of the machine, with normal rotation of the motor M3, the supporting rod 20 is turned in a counterclockwise direction to the original position shown in FIG. 2 from the above-mentioned displaced position. A rotary arm 49 corresponding to the roller holder 21 in each spinning unit is fixed to the supporting rod 20. This rotary arm 49 is rotated with the rotation of the supporting rod 20 at the time of the starting or stopping of the operation of the machine so that the top end **49*a* of the rotary arm 49 falls into engagement with the roller holder 21 to turn the roller holder 21 in the clockwise or counterclockwise direction in FIG. 3. Accordingly, at the time of the stopping of the operation of the machine, the roller holder 21 is turned in the clockwise direction by the rotary arm 49 from the position indicated by solid lines in FIG. 2 to the position indicated by a chain line in FIG. 2. As a result, the top roller 22 is separated and spaced from the draw-off roller 19 and the yarn 16 is released from the nip between the rollers 19 and 22. Further, after completion of the yarn piecing operation at the time of the starting of the operation of the machine, the roll holder 21 is turned in the counterclockwise direction by the rotary arm 49 from the position indicated by a chain line in FIG. 2 and the top roller 22 is caused to fall into contact with the draw-off roller 19, whereby the yarn 16 is nipped between the rollers 19 and 22**.

The circuit structure of the electrical control device 39 will now be described in detail by reference to FIGS. 7A–7C. This circuit structure includes first to 22nd circuits connected to a power line L—L.

A starting push button switch PB1 of the normally open type and an electromagnetic contactor MS for the motors M1 and M2 are connected to the first circuit. A normally open contact MS-1 of the electromagnetic contactor MS for self-retention is connected in parallel to the starting push button switch PB1. Normally open contact MS-2 are normally closed contact MS-3 are connected to the second and 11th circuits, respectively. A timer TR0 for confirmation of the start of the motors M1 and M2 is connected to the second circuit. A normally open contact TR0-1 of the timer TR0 is connected to the third circuit. A first relay CR1 is connected to the third circuit in parallel to the timer TR0 and its normally open contact CR1-1 for self-retention is connected in parallel to the normally open contact MS-2 of the second circuit. Normally open contacts CR1-2, CR1-3 and CR1-5 of the relay CR1 are connected to the fourth, fifth and 18th circuits, respectively and normally closed circuits CR1-4 and CR1-6 of the relay CR1 are connected to the ninth and 21st circuits, respectively.

The fourth, fifth and sixth circuits are connected in parallel to the normally open contact TR0-1 and first relay CR1 of the third contact. A timer for setting the timing of delayed start of the feed roller 12 according to the quantity of the yarn of the yarn package 29 is connected to the fourth circuit. This timer includes a timer output portion B and a plurality of timer setting portions T1, T2 and T3 connected in parallel to one another, so that as the quantity of the yarn of the yarn package 29 increases, the setting time is prolonged. A normally open contact B-1 of the timer output portion B is connected to the sixth circuit. A timer for setting the timing of delayed changeover of the rotation direction of the draw-off roller 19 and winding roller 23 from the reverse direction of the normal direction according to the quantity of the yarn of the yarn packages 29 is connected to the fifth circuit. This timer includes a timer output portion C and a plurality of timer setting portions T4, T5 and T6 connected in parallel to one another, so that as the quantity of the yarn of the yarn package 29 increases, the setting time is shortened. A normally open contact C-1 of the timer output portion C is connected to the seventh circuit. A second relay CR2 is connected to the sixth circuit and its normally open contact CR2-1 for self-retention is connected in parallel to the normally open contact B-1 of the sixth circuit. Normally open circuits CR2-3 and CR2-4 of the relay CR2 are connected to the 16th and 19th circuits, respectively and normally closed circuits CR2-2 and CR2-5 are connected to the ninth and 22nd circuits, respectively.

A third relay CR3 is connected to the seventh circuit and its normally open contact CR3-1 for self-retention is connected in parallel to the normally open contact C-1 of the seventh circuit. Normally open contacts CR3-2, CR3-3, CR3-4, CR3-6 and CR3-8 of the relay CR3 are connected to the eighth, ninth, 15th, 20th and 22nd circuits, respectively and normally closed contacts CR3-5 and CR3-7 of the relay CR3 are connected to the 18th and 21st circuits, respectively. A first timer TR1 is connected to the eighth circuit and a normally closed contact TR1-1 of the timer TR1 is connected to the 15th circuit. A second timer TR2 is connected to the ninth circuit and a normally closed contact TR2-1 of the timer TR2 is connected to the seventh circuit. A stopping push button switch PB2 of the normally closed type and a fourth relay CR4 are connected to the 10th circuit and a normally open contact CR4-2 of the relay CR4 for self-retention is connected to the 11th circuit in parallel to the stopping push button switch PB2. A normally open contact CR4-3 of the relay CR4 is connected to the 16th circuit and a normally closed contact CR4-1 of the relay CR4 is connected to the first circuit. A timer for setting the timing of delayed stopping of the draw-off roller 19 and winding roller 23 according to the quantity of the yarn of the yarn package 29 is connected to the 11th circuit. This timer includes a timer output portion A and a plurality of timer setting portions T7, T8 and T9 connected in parallel to one another, so that as the quantity of the yarn of the yarn package 29 increases, the setting time is prolonged. A normally closed contact of the timer output portion A is connected to the third circuit in series with the normally open contact CR1-1, and other normally closed contacts A-2 and A-3 are connected to the 10th and 12th circuits, respectively.

The sensing switch LS1 of the detecting device 40 and a fifth relay CR5 are connected to the 12th circuit, and a normally open contact CR5-4 of the relay CR5 for self-retention is connected to the 12th circuit in parallel to the sensing switch LS1. Normally open contacts CR5-1, CR5-2 and CR5-3 of the relay CR5 are connected to the fourth, fifth and 11th circuits in series with the timer setting portions T1, T4 and T7, respectively, and normally closed contacts CR5-5 and CR5-6 of the relay CR5 are connected to the 13th and 14th circuits, respectively. The 13th and 14th circuits are connected in parallel to the sensing switch LS1 and fifth relay CR5 of the 12th circuit. The sensing switch LS2 of the detecting device 40 and a sixth relay CR6 are connected to the 13th circuit, and a normally open contact CR6-5 of the relay CR6 for self-retention is connected to the 13th circuit in parallel to the sensing switch LS2. Normally open contacts CR6-1, CR6-2 and CR6-3 of the relay CR6 are connected to the fourth, fifth and 11th circuits in series to the timer setting portions T2, T5 and T8, respectively, and normally closed contacts CR6-4 and CR6-6 of the relay CR6 are connected to the 12th and 14th circuits, respectively. The sensing switch LS3 of the detecting device 40 and a seventh relay CR7 are connected to the 14th circuit, and a normally open contact CR7-6 of the relay CR7 for self-retention is connected to the 14th circuit in parallel to the sensing switch LS3. Normally open contacts CR7-1, CR7-2 and CR7-3 of the relay CR7 are connected to the fourth, fifth and 11th circuits in series with the timer setting portions T3, T6 and T9, respectively, and normally closed contacts CR7-4 and CR7-5 of the relay CR7 are connected to the 12th and 13th circuits, respectively.

An electromagnetic contactor MSF for normal rotation of the motor M3 for driving the supporting rod 20 is connected to the 15th circuit, and its normally closed contact MSF-1 is connected to the 16th circuit. An electromagnetic contactor MSR for reverse rotation of the motor M3 for driving the supporting rod 20 is connected to the 16th circuit, and its normally closed contact MSR-1 is connected to the 15th circuit. A third timer TR3 is connected to the 17th circuit in parallel to the normally open contact CR4-3 of the 16th circuit, and a normally open contact TR3-1 of the timer TR3 is connected to the 11th circuit and a normally closed circuit TR3-2 of the timer TR3 is connected to the 16th circuit.

The electromagnetic clutch MC1 for reverse rotation of the draw-off roller 19 and winding roller 23 is connected to the 18th circuit, and the electromagnetic clutch MC2 for connection to the feed roller 12 is connected to the 19th circuit. The electromagnetic clutch MC3 for normal rotation of the draw-off roller 19 and winding roller 23 is connected to the 20th circuit, and the electromagnetic brake MB1 for controlling the draw-off roller and winding roller 23 is connected to the 21st circuit. The electromagnetic brake MB2 for controlling the feed roller 12 is connected to the 22nd circuit.

The operation of the open-end spinning machine having the above-mentioned structure will now be described.

The case where the operation of the machine is started is firstly described. At the time of the start of the operation of the machine, as indicated by a chain line in FIG. 2, the top roller 22 is spaced from the draw-off roller 19 and the yarn 16 is kept released from nip between the rollers 19 and 22. One of the sensing switches LS1, LS2 and LS3 of the detecting device 40, shown in FIGS. 4 to 6, is selectively closed according to the quantity of the yarn of the yarn package 29, and the corresponding relay CR5, CR6 or CR7 in the 12th to 14th circuits shown in FIG. 7B is energized to change over the contacts thereof.

Figure 7A:
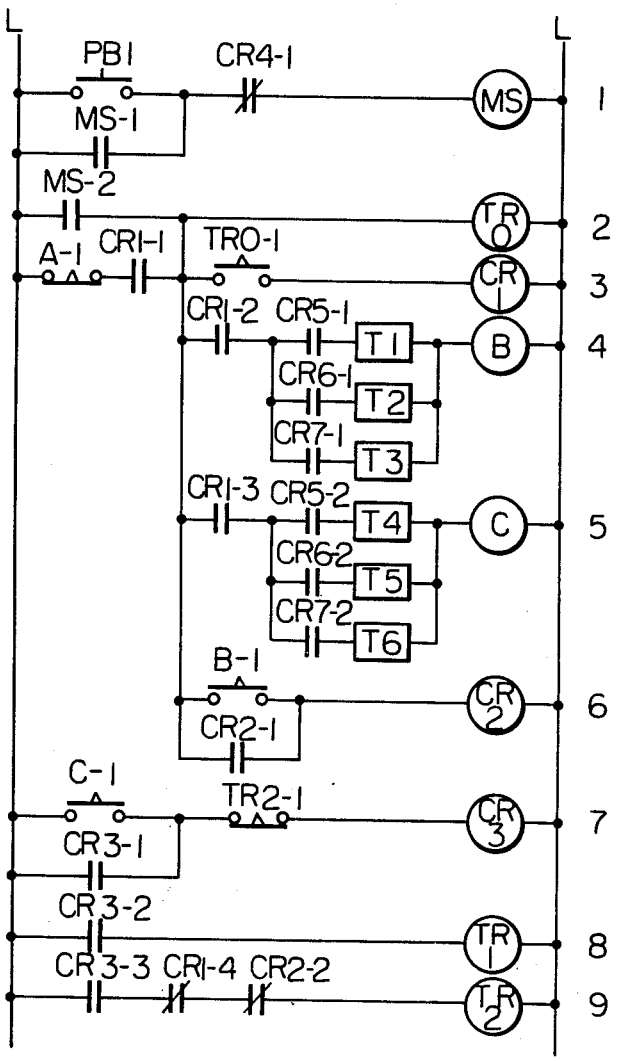
FIGS. 7A to 7C are block diagrams illustrating control circuits of the control apparatus according to the present invention.
Figure 7B:
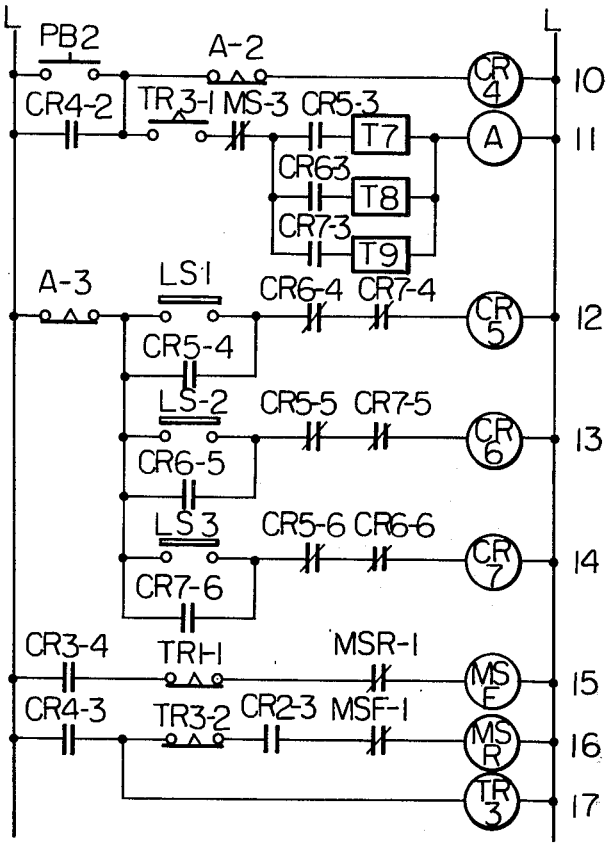
Figure 7C:
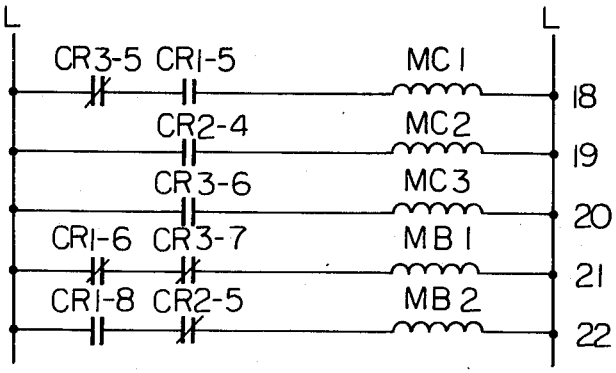

In this state, if the starting push button switch PB1 of the first circuit shown in FIG. 7A is closed, the electromagnetic contactor MS is energized to close the normally open contact MS-2 of the second circuit and set the timer TR0. Simultaneously, by energization of the electromagnetic contactor MS the motors M1 and M2 are actuated to rotate and drive the normal rotation shaft 31 for the draw-off roller 19 and winding roller 23, the reverse rotation shaft 32 for the draw-off roller 19 and winding roller 23, the driving shaft 33 for the feed roller 12 and the combing roller 13 and rotary spinning chamber 14 in each yarn spinning unit 11. When the rotation speeds of the respective members mentioned above arrive at predetermined levels and the time set in the timer TR0 of the second circuit has passed, the normally open contact TR0-1 of the third circuit is closed to energize the first relay CR1. By energization of the first relay CR1, the normally open contacts CR1-2 and CR1-3 of the fourth and fifth circuits are closed to set one of the timer setting portions T1 to T6 selectively, according to the quantity of the yarn of the yarn package 29. More specifically, when the quantity of the yarn of the yarn package 29 is small, the sensing switch LS1 of the 12th circuit is closed to energize the fifth relay CR5 and, at this point, the normally open contact CR5-1 and CR5-2 are in the closed state. Accordingly, the timer setting portion T1 of the fourth circuit where the set time is short is set and the timer setting portion T4 of the fifth circuit where the set time is long is set. When the quantity of the yarn of the yarn package 29 is large, the sensing switch LS3 of the 14th circuit is closed to energize the seventh relay CR7 and, at this point, the normally open contacts CR7-1 and CR7-2 are in the closed state. Accordingly, the timer setting portion T3 of the fourth circuit where the set time is long is set, and the timer setting portion T6 of the fifth circuit where the set time is short is set.

Further, when the first relay CR1 is energized, the normally closed contact CR1-6 of the 21st circuit is opened to de-energize the electromagnetic brake MB1 for controlling the draw-off roller 19 and winding roller 23, and simultaneously, the normally open contact CR1-5 of the 18th circuit is closed to excite the electromagnetic clutch MC1 for reverse rotation and start the reverse rotation of the draw-off roller 19 and winding roller 23 shown in FIGS. 1 and 2. Accordingly, the yarn 16 being wound on the yarn package 29 is fed back to the rotary spinning chamber 14 through the guide tube 17. While the yarn 16 is thus fed back, the top roller 22 is spaced from the draw-off roller 19 as indicated by chain lines in FIG. 2. Therefore, even if on initiation of the reverse rotation of the winding roller 23, a slip is caused on the yarn package 29 and initiation of the reverse rotation of the yarn package 29 is delayed behind the start of the reverse rotation of the winding roller 23, according to the quantity of the yarn of the yarn package 29, the tension on the yarn 16 is not increased and yarn breakage can be definitely prevented.

After initiation of the reverse rotation of the draw-off roller 19 and winding roller 23, the time set in the timer portion T1, T2 or T3, according to the quantity of the yarn wound on the yarn package 29, has passed and the timer output potion B is actuated. Accordingly, the normally open contact B-1 of the sixth circuit is closed to energize the second relay CR2. By energization of the second relay CR2, the normally open contact CR2-4 of the 19th circuit is closed to excite the electromagnetic clutch MC-2 and connect the feed roller 12 shown in FIG. 1 to the driving shaft 33, whereby feeding of the fiber bundle 15 is started. The timing of this delayed start of the feed roller 12 is set by the sensing switches LS1, LS2 and LS3 and the timer setting portions T1, T2 and T3 differing in the set time, in the same manner as described hereinbefore. Consequently, as the quantity of the yarn wound on the yarn package 29 becomes large, the timing of the delayed start of the feed roller 12 is retarded. Accordingly, even if a slit is caused on the cheese 29 at the time of the start of the reverse rotation of the winding roller 23 and the initiation of feedback of the yarn 16 is delayed according to the quantity of the yarn wound on the cheese 29, the contact timing between the end of the yarn bed back to the rotary spinning chamber and the opened fibers fed to the rotary spinning chamber is not upset at all but is precisely controlled.

When the time set in the timer setting portion T4, T5 or T6 of the fifth circuit, according to the quantity of the yarn wound on the yarn package 29, has passed in this state, the timer output portion C is actuated to close the normally open contact C-1 of the seventh circuit and energize the third relay CR3. By energization of the third relay CR3, the normally closed circuit CR3-5 of the 18th circuit is opened to de-energize the electromagnetic clutch MC1, and simultaneously, the normally open contact CR3-6 of the 20th circuit is closed to excite the electromagnetic clutch MC3 and change over the rotation direction of the draw-off roller 19 and winding roller 23 from the reverse direction to the normal direction. Accordingly, the yarn 16 is taken out from the spinning rotor 14 through the guide pipe 17 and the yarn piecing operation is performed. The timing of delayed changeover of the rotation direction of the draw-off roller 19 and winding roller 23 from the reverse direction to the normal direction is set by the sensing switches LS1, LS2 and LS3 and the timer setting portions T4, T5 and T6, differing in the set time, in the same manner as described hereinbefore. As a result, as the quantity of the yarn wound on the yarn package 29 becomes large, the above timing of delayed changeover of the rotation direction is quickened. Accordingly, even if a slip is caused on the cheese when the rotation direction of the winding roller 23 is changed over from the reverse direction to the normal direction and if initiation of the normal rotation of the cheese 29 is delayed behind initiation of the normal rotation of the winding roller 23, the timing of taking out the yarn 16 from the spinning rotor 14 is not upset and the yarn tying operation can be definitely performed. Further, also at the time of this changeover of the rotation direction from the reverse direction to the normal direction, the top roller 22 is separated and spaced from the draw-off roller 19 as indicated by chain lines in FIG. 2. Therefore, even if the yarn package 29 is rotated by the force of inertia with changeover of the rotation direction of the winding roller 23 from the reverse direction to the normal direction, the yarn end is sucked in the spinning rotor 14 and applied to the yarn tying operation. As a result, loosening of the yarn 16 can be definitely prevented.

Figure 3:
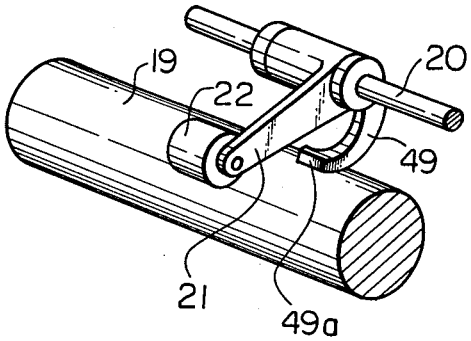
FIG. 3 is a perspective view showing the structure for a top roller arrangement of the open-end spinning unit shown in FIG. 2.

By energization of the third relay CR3, the normally open contact CR3-2 of the eighth circuit is also closed to set the first timer TR1, and simultaneously, the normally open contact CR3-4 of the 15th circuit is closed to energize the electromagnetic contactor MSF and rotate the motor M3, shown in FIG. 3, in the normal direction. Accordingly, the supporting rod 20 is turned in the counterclockwise direction in FIG. 2 through the driving gear 48 and driven gear 47, and the roller holders 21 in the respective spinning units are simultaneously turned from the position indicated by chain lines in FIG. 2. As a result, the top roller 22 is caused to fall into contact with the draw-off roller 19. Since the time set in the first timer TR1 has passed afterwards, the normally closed contact TR1-1 of the 15th circuit is opened to de-energize the electromagnetic contactor MSF and stop the motor M3 for driving the supporting rod 20. Accordingly, in this state, as indicated by solid lines in FIG. 2, the yarn 16 spun out from the rotary spinning chamber 14 is nipped between the top roller 22 and the draw-off roller 19 and is wound on the outer periphery of the bobbin 27 with normal rotation of the draw-off roller 19 and winding roller 23.

The case where the operation of the machine is stopped will now be described.

Figure 6:
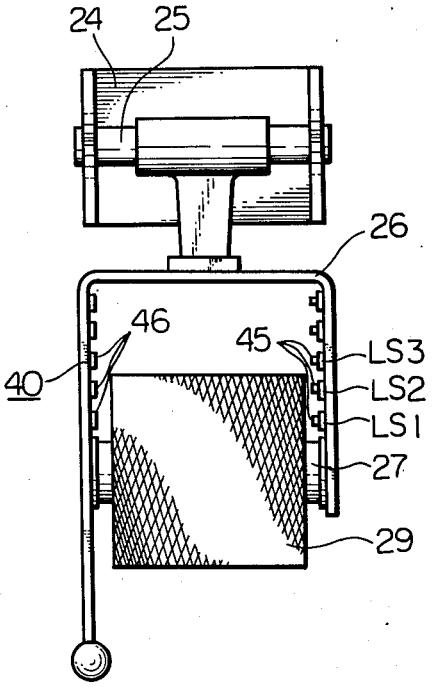
FIG. 6 is a plan view showing another embodiment for detecting the quantity of a yarn wound on a yarn package.

At the time of the stopping of the operation of the machine, one of the sensing switches LS1, LS2 and LS3 of the detecting device 40 shown in FIGS. 4 to 6 is selectively closed, according to the quantity of the yarn wound on the yarn package 29, and the corresponding relay CR5, CR6 or CR7 in the 12th to 14th circuits shown in FIG. 7-(b) is energized to change over the contacts thereof. In this state, when the stopping push button switch PB2 of the 10th circuit is closed, the fourth relay CR4 is energized to closed the normally open contact CR4-3 of the 16th circuit and set the third timer TR3. Simultaneously, the electromagnetic contactor MSR is energized to rotate the motor M3 shown in FIG. 3 in the reverse direction. Accordingly, the supporting rod 20 is turned in the clockwise direction in FIG. 2 and the roller holders 21 of the respective spinning units are simultaneously turned in the same direction. As a result, the top roller 21 is separated and spaced from the draw-off roller 19. Further, by energization of the fourth relay CR4, the normally closed contact CR4-1 of the first circuit is opened to de-energize the electromagnetic contactor MS, whereby the motors M1 and M2, shown in FIG. 1, are stopped after inertial rotation and each of the draw-off roller 19, winding roller 23, feed roller 12, combing roller 13 and rotary spinning chamber 14 starts inertial rotation.

When the time set in the third timer TR3 has passed afterwards, the normally closed contact TR3-2 of the 16th circuit is opened to de-energize the electromagnetic contactor MSR and stop the motor M3 for driving the supporting rod 20. Further, when the time set in the third timer TR3 has passed the normally open contact TR3-1 of the 11th circuit is closed and, therefore, one of the timer setting portions T7, T8 and T9 is set selectively according to the quantity of the yarn wound on the yarn package 29. More specifically, when the quantity of the yarn wound on the yarn package 29 is small, by the closing of the sensing switch SL1 of the 12th circuit, the fifth relay CR5 is energized, and the normally open contact CR5-3 of the 11th circuit is in the closed state. Accordingly, the timer setting portion T7 having a short set time is set. When the quantity of the yarn wound on the yarn package 29 is large, by the closing of the sensing switch LS3 of the 14th circuit, the seventh relay CR7 is energized, and the normally open contact CR7-3 of the 11th circuit is in the closed state. Accordingly, the timer setting portion T9 having a long set time is set.

Then, the speeds of the draw-off roller 19 and winding roller 23 are lowered because they are rotated only by the force of inertia, and the time set in one of the timer setting portions T7, T8 and T9 of the 11th circuit selectively, according to the quantity of the yarn wound on the yarn package 29, has passed and the timer output portion A is actuated to open the normally closed contact A-1 of the third circuit and de-energize the first relay CR1 of the third circuit and the second relay CR2 of the sixth circuit. Simultaneously, the normally closed contact A-2 of the 10th circuit is opened to de-energize the fourth relay CR4. By de-energization of the first relay CR1, the normally closed contact CR1-4 of the ninth circuit is closed and by de-energization of the second relay CR2, the normally closed contact CR2-2 of the ninth circuit is closed. Accordingly, the second timer TR2 is set. Further, by de-energization of the second relay CR2, the normally open contact CR2-4 of the 19th circuit is opened to de-energize the electromagnetic clutch MC2, and the normally closed contact CR2-5 of the 22nd circuit is closed to excite the electromagnetic brake MB2, whereby the feed roller 12 shown in FIG. 1 is separated from the driving shaft 33 and abruptly controlled and stopped by the electromagnetic brake MB2 to stop feeding of the fiber bundle 15.

When the time set in the second timer TR2 has passed afterwards, the normally closed contact TR2-1 of the seventh circuit is opened to de-energize the third relay CR3. By de-energization of the third relay CR3, the normally open contact CR3-6 of the 20th circuit is opened to de-energize the electromagnetic clutch MC3 and the normally closed contact CR3-7 of the 21st circuit is closed to excite the electromagnetic brake MB1. As a result, the draw-off roller 19 and winding roller 23 are separated from the shaft 31 for normal rotation and abruptly controlled and stopped by the electromagnetic brake MB1. Since the timing of the delayed stopping of the draw-off roller 19 and winding roller 23 is set by the sensing switches LS1, LS2 and LS3 and the timer setting portions T7, T8 and T9 differing in the set time, as described hereinbefore, so that as the quantity of the yarn wound on the cheese 29 becomes large the above timing of delayed stopping is retarded, especially in case of a large quantity of the wound yarn, the draw-off roller 19 and winding roller 23 are controlled and stopped when their speeds are sufficiently lowered with the inertial rotation. Accordingly, the influence of the force of inertia on the cheese 29 is reduced to a minimum level and the yarn end can be retained at a certain position in the guide tube 17.

As will be apparent from the foregoing illustration, according to the present invention, at the time of the start of the operation of the machine, the quantity of the yarn of the yarn package is detected and the timing of initiating the feeding of fibers and the timing of changing over the rotation direction of the winding roller from the reverse direction to the normal direction are set based on a signal of detection of the quantity of the wound yarn. Consequently, as the quantity of the yarn wound on the yarn package becomes large, the timing of delayed start of feeding of fibers is retarded and the timing of delayed changeover of the rotation direction of the draw-off roller and winding roller from the reverse direction to the normal direction is quickened. As a result there can be attained an excellent effect that the ratio of success in the yarn piecing operation can be remarkably enhanced.

The present invention is not limited to the foregoing embodiment, but as will be apparent to those skilled in the art, the present invention can be applied to an open-end spinning machine of the type where the draw-off roller 19 and top roller 22 are not used, and also in this case, excellent effects can be similarly attained to those in the foregoing embodiment.

What is claimed is:

1. A driving control apparatus for an open-end spinning machine provided with a plurality of spinning units each comprising a spinning rotor, a feed roller for feeding a bundle of fibers to said spinning rotor, a winding roller for taking out a yarn from said spinning rotor and winding the yarn to form a yarn package, a holder for rotatably supporting said yarn package, and provided with a driving device for driving said feed roller and said winding roller, respectively, said driving device including clutch means; comprising means for detecting the quantity of the wound yarn on said yarn package and control means for setting operational timings of said feed roller and said winding roller based on a value detected by said detecting means, said control means comprising (i) means for on-off controlling said clutch means at said set operational timings, and (ii) means for setting the timing of stopping of the winding roller at the time of the stopping of the machine according to a detected value of said detecting means so that the time for low-speed rotation of the winding roller prior to the stopping thereof is prolonged as the quantity of the wound yarn on said yarn package becomes large.

2. A driving control apparatus according to claim 1 wherein said detecting means includes said holder, a rotation shaft co-operable with the turning of said holder and means for detecting the rotation angle of said rotation shaft comprising a plurality of limit switches capable of being selectively engaged with a part of said rotation shaft.

3. A driving control apparatus according to claim 1 wherein said detecting means includes said holder, a rotation shaft co-operable with the turning of said holder and means for detecting the rotation angle of said rotation shaft comprising a potentiometer disposed on a part of said rotation shaft to detect the quantity of the wound yarn on said yarn package from the turning angle of said rotation shaft.

4. A driving control apparatus according to claim 1 wherein said holder is a cradle arm and said detecting means comprises a plurality of photoelectric tubes arranged in such a condition that light is intercepted selectively in one of said photoelectric tubes according to the turning angle of said cradle arm and the quantity of the wound yarn of said yarn package is detected from the turning angle of the cradle arm.

5. A driving control apparatus according to claim 1 wherein said holder is a cradle arm and said detecting means comprises a plurality of sensing switches disposed on the inside of said cradle arm, each sensing switch including a confronting light emitting element and a light receiving element, and wherein said sensing switches are arranged so that light is intercepted selectively in one of said sensing switches according to the quantity of the wound yarn of said yarn package.

6. A driving control apparatus according to claim 1 wherein said control means further comprises means for setting the timing of the start of the feed roller according to a value detected by said detecting means at the time of the start of the machine so that the timing of the start of the feed roller is retarded as the quantity of the wound yarn of said yarn package becomes large.

7. A driving control apparatus according to claim 6 wherein said control means further comprises means for setting the timing of the changing over of the rotation direction of the winding roller at the time of the start of the machine from the reverse direction for feeding back the yarn end to the spinning rotor to the normal direction for taking out the yarn from the spinning rotor, so that said timing of the changeover of the rotation direction of the winding roller from the reverse direction to the normal direction is quickened as the quantity of the wound yarn on said yarn package becomes large.

8. A driving control apparatus according to claim 7 wherein said timing setting means includes a plurality of timers differing in set time, one of which is selectively started according to a detected value of said detecting means and actuates said clutch means after the lapse of the set time.

9. A driving control apparatus according to claim 1 wherein said control means includes first time setting means which is actuated after a predetermined time in cooperation with instruction signals for stopping the driving devices of said feed roller and winding roller, a plurality of second time setting means being operable when the time set in the first time setting means has passed and being actuated selectively according to the quantity of the wound yarn of said yarn package to stop the feed roller when the time set in the second time setting means has passed, and third time setting means actuated when the time set in the second time setting means has passed, to stop the winding roller when the time set in said third time setting means has passed.

10. Apparatus according to claim 1, further comprising:

a draw-off roller and a top roller peripherally engaged therewith for continuously taking yarn from said spinning rotor during normal spinning operation, and means for separating the peripheries of said rollers to release said yarn at the time of starting or stopping the spinning operation of said open-end spinning machine.

* * * * *